US007281697B2

(12) United States Patent
Reggiani

(10) Patent No.: US 7,281,697 B2
(45) Date of Patent: Oct. 16, 2007

(54) SUPPORTING DEVICE FOR A LIGHTING APPLIANCE

(75) Inventor: Fabio Reggiani, Vedano Al Lambro (IT)

(73) Assignee: Reggiani S.p.A. Illuminazione, Sovico, Milan (IT)

( * ) Notice: Subject to any disclaimer, the term of this patent is extended or adjusted under 35 U.S.C. 154(b) by 185 days.

(21) Appl. No.: 11/077,622

(22) Filed: Mar. 11, 2005

(65) Prior Publication Data

US 2005/0207146 A1 Sep. 22, 2005

(30) Foreign Application Priority Data

Mar. 18, 2004 (IT) ..... MI2004A0515

(51) Int. Cl.
*A47H 1/10* (2006.01)

(52) U.S. Cl. ..... 248/323; 248/324; 248/317; 248/343; 248/221.11; 248/222.11; 248/222.52; 362/362; 362/364; 362/365; 362/366; 362/368; 362/370; 362/150

(58) Field of Classification Search ..... 248/323, 248/324, 317, 343, 221.11, 222.11, 222.52; 362/364, 362, 365, 366, 368, 370, 371, 374, 362/150

See application file for complete search history.

(56) References Cited

U.S. PATENT DOCUMENTS

| | | | | |
|---|---|---|---|---|
| 4,048,491 | A * | 9/1977 | Wessman | 362/364 |
| 5,931,432 | A * | 8/1999 | Herold et al. | 248/343 |
| 5,964,523 | A * | 10/1999 | Eversberg | 362/365 |
| 6,241,368 | B1 * | 6/2001 | Depino | 362/364 |
| 6,505,960 | B2 * | 1/2003 | Schubert et al. | 362/365 |
| 6,652,124 | B2 * | 11/2003 | Schubert et al. | 362/285 |

* cited by examiner

*Primary Examiner*—Carl D. Friedman
*Assistant Examiner*—Todd M. Epps
(74) *Attorney, Agent, or Firm*—Hedman & Costigan P.C.; James V. Costigan

(57) ABSTRACT

Supporting device (10) for a lighting appliance comprising a frame (11) in turn comprising a tubular portion (12) which can be at least partially inserted in a housing or opening (17) of a false ceiling or wall (18). According to the invention, the device (10) comprises supporting means (20) comprising at least two levers (30) associated with the frame (11) and capable of passing, by rotation, by means of two corresponding unidirectional couplings (34, 52) from a disengagement operating position, in which they do not protrude from said tubular portion (12), to an engagement operating position in which they protrude from said frame (11) becoming coupled with said wall (18) to support the device (10).

17 Claims, 5 Drawing Sheets

Fig.6A
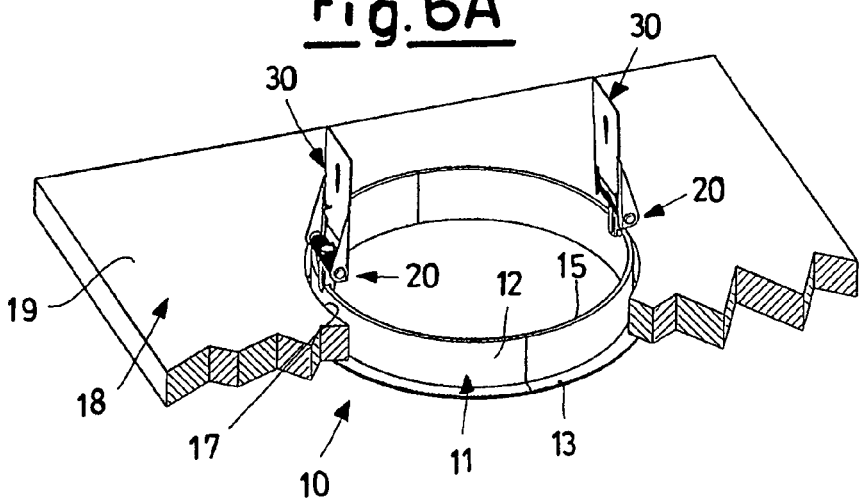
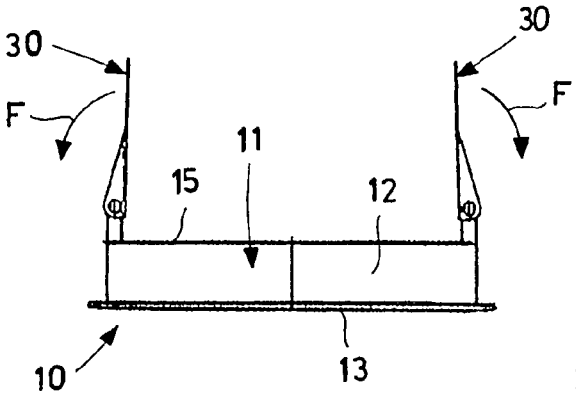
Fig.7A
Fig.6B
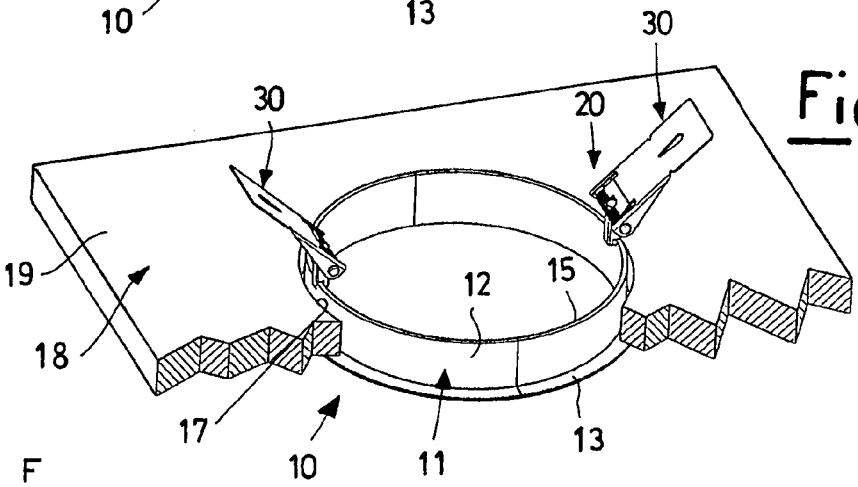
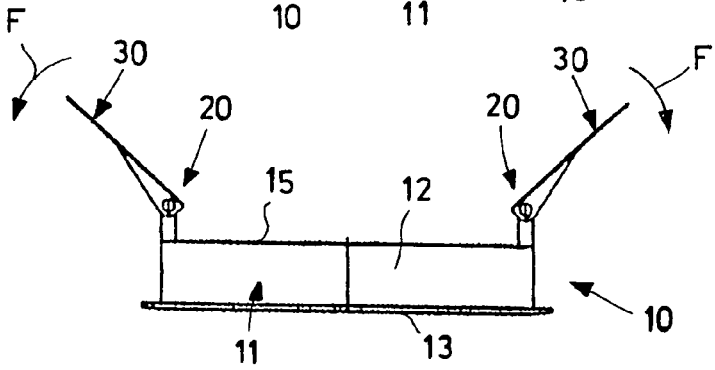
Fig.7B

SUPPORTING DEVICE FOR A LIGHTING APPLIANCE

The present invention relates to a supporting device for a lighting appliance.

Known supporting devices which can be used for holding lighting appliances of the built-in type generally comprise a frame, inserted in an opening situated in a false ceiling, or wall, and subsequently screwed—or fixed in another way—to hold the lighting appliance.

One of the disadvantages of current devices is that the fixing elements and installation of the frame, are not only costly to produce but are also visible to the eye and this is often jeopardizing from an aesthetic point of view.

This also occurs in more sophisticated supporting devices, as in the case, for example, of patent EP 0 525 907, which describes and illustrates a fixing device comprising a metallic maneuvering strip which allows the installation of the device itself, and which also remains visible at the end of the fixing operation of the frame to the false ceiling.

Another disadvantage of the known devices is that they require complicated setting-up operations, which are onerous both in terms of time and costs.

After fixing the frame to the wall, it is very often necessary, in fact, to plaster the spaces between the opening and the frame to improve its overall appearance.

A general objective of the present invention is to solve the above drawbacks of the known art in an extremely simple, economical and functional way, with particular reference to supporting frames through which it is possible to have access to the internal part of the false ceiling, i.e. suitable for subsequently receiving the lighting appliance.

A further objective is to provide a supporting device for a lighting appliance which is easy and simple to assemble.

Another objective of the present invention is to provide a supporting device for a light appliance which avoids the necessity of finishing operations such as, for example, plastering the spaces between the frame and opening in which it has been inserted.

In view of the above objectives, the present invention proposes to provide a supporting device for a lighting appliance, having the characteristics indicated in the enclosed claims.

The structural and functional characteristics of the present invention and its advantages with respect to the known art will appear more evident from an examination of the following description, referring to the enclosed drawings which illustrate two examples of supporting devices for a lighting appliance produced according to the innovative principles of the invention itself.

In the drawings:

FIGS. 6A, 6B and 6C are raised perspective views from above which show successive phases of the assembly of a preferred embodiment of a supporting device according to the present invention in a housing or opening of a false ceiling or partially split wall;

FIGS. 7A, 7B and 7C are raised front views which show the successive configurations of a supporting device in the phases illustrated in FIGS. 6A, 6B and 6C, respectively;

Figure 1:
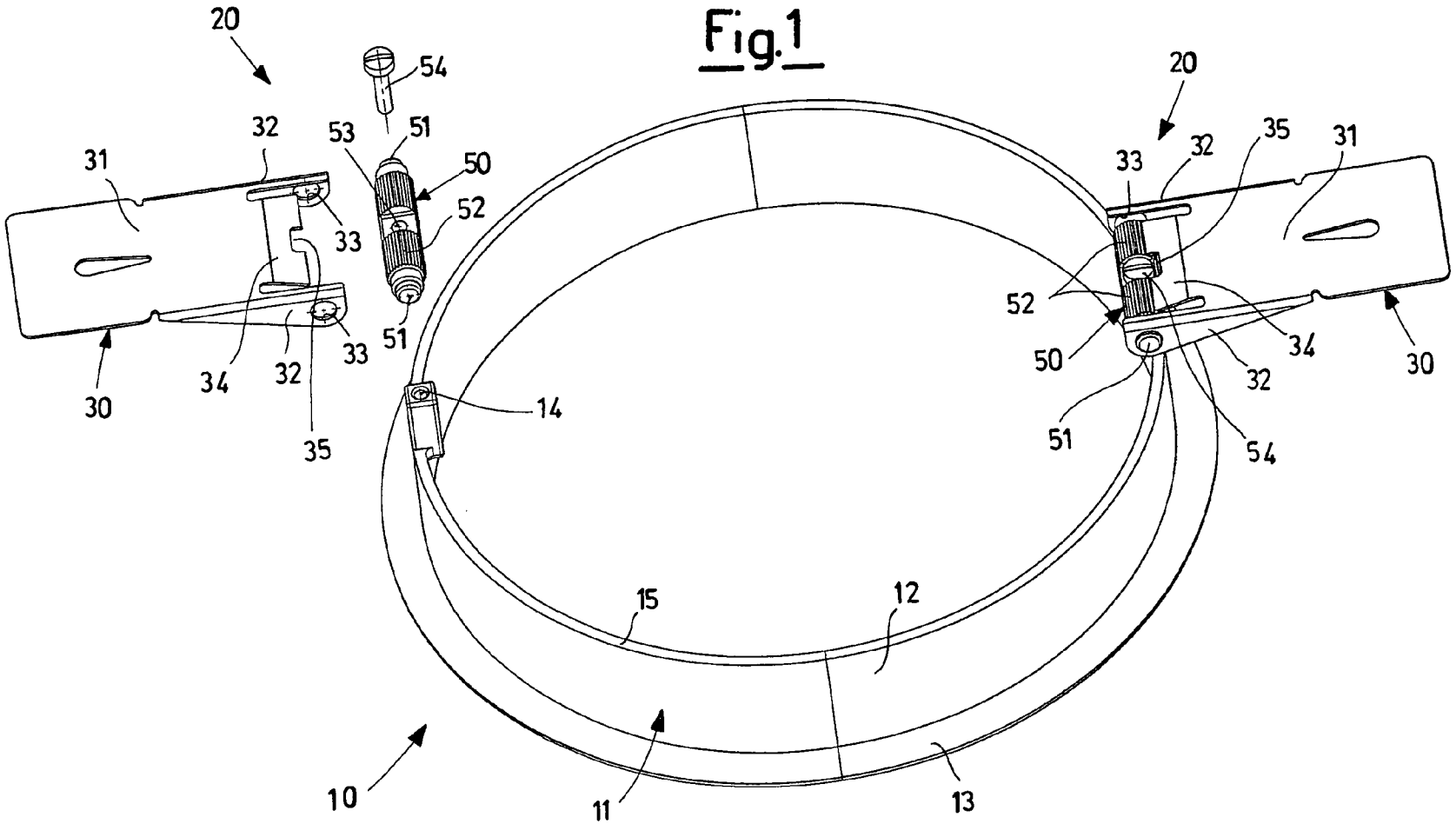
FIG. 1 shows a partially exploded raised perspective view of an embodiment of a supporting device for a lighting appliance according to the present invention.
Figure 2:
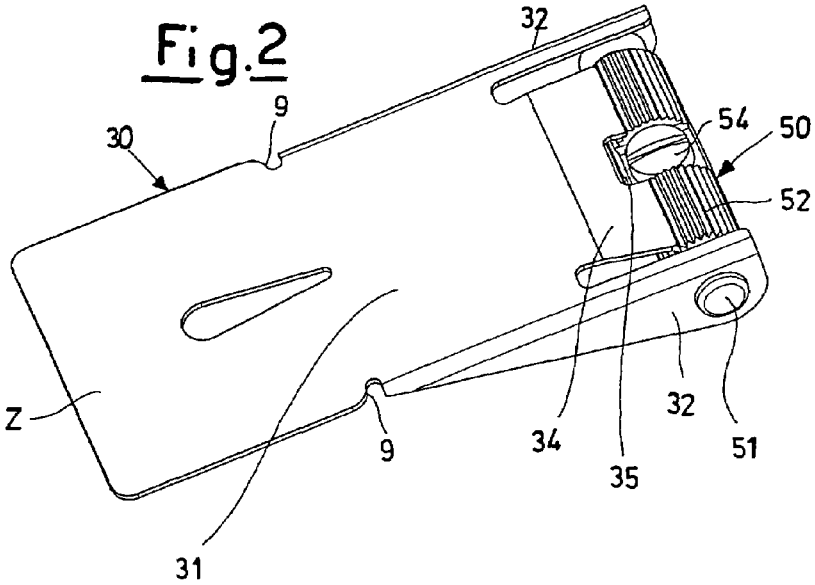
FIG. 2 is a perspective view of a detail of FIG. 1.
Figure 3:
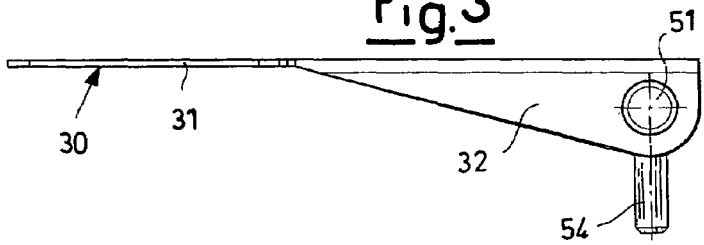
FIG. 3 is a raised side view of the detail of FIG. 2.
Figure 5:
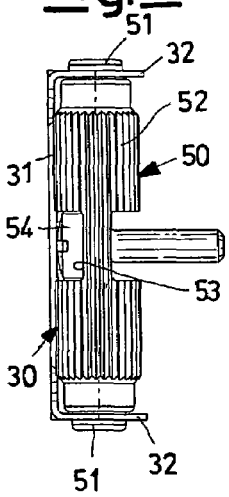
FIG. 5 is a raised view of the detail of FIG. 2.
Figure 4:
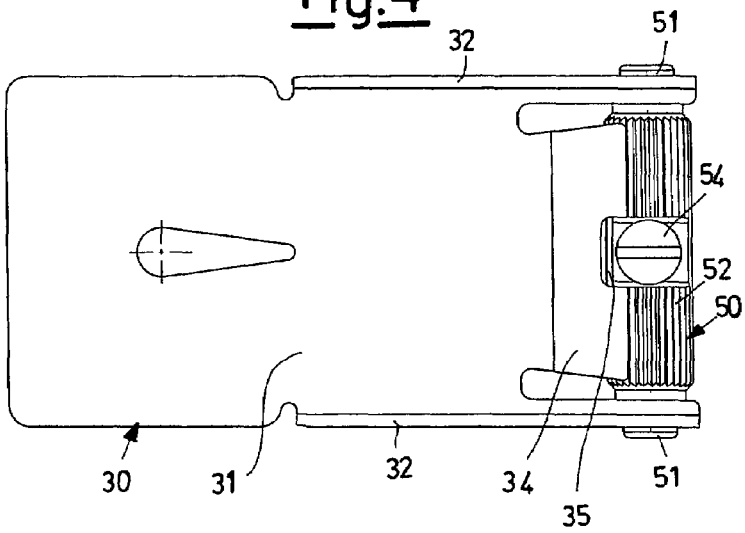
FIG. 4 is a view from above of the detail of FIG. 2.

With reference to the drawings, a supporting device for a lighting appliance in question is indicated as a whole with 10 and, in the example illustrated, according to the present invention, comprises a frame 11, which can be inserted in a housing or opening 17 of a false ceiling or wall 18, and supporting means 20 suitable for holding up the frame 11 after it has been inserted in the opening 17 of the wall 18.

The lighting appliance, not shown in the figures, is preferably of the built-in type and is also inserted in an opening 17 and is suitable for being fixed to the frame 11 of the supporting device 10.

The frame 11 preferably comprises a tubular portion 12, which can be inserted in the opening 17 of a false ceiling or wall 18, having a first and a second end.

The frame 11 also envisages a flanged portion 13 which extends radially outwards starting from the second end.

The tubular portion 12 has a section which is preferably in the shape of a circular crown, or rectangular or square crown, or a regular or irregular polygonal crown.

In the example shown, the tubular portion 12 has a circular crown-shaped section having an outer diameter D which is slightly smaller than the diameter of the opening 17.

The supporting means 20 comprise at least two levers 30, preferably metallic, each of which is associated with the frame 11 respectively by means of a pin 50 fixed to the first end 15 of the tubular portion 12.

Each pin 50 is equipped with a hole 53 for the insertion of a respective screw 54 which allows fixing by screwing into a corresponding housing 14 situated on the first end 15 of the tubular portion 12.

Furthermore, each pin 50 has tapered ends 51 and a knurled portion 52 situated on its side surface.

Each lever 30 comprises a lamellar base portion 31 suitable for being coupled with the upper surface 19 of the wall 18, and two side portions 32, opposite to each other with respect to the base portion 31 and preferably orthogonal thereto.

Said base portion 31 has an elastically yieldable area, independent of the side portions 32, and delimited by the free end of the lever 30 and by two opposite side notches 9, identifying a lower resistance line.

In each side portion 32, there is a housing or hole 33 for the respective insertion of one of the two end portions 51.

The at least two levers 30 are therefore hinged to the frame 11 each respectively by means of a knurled pin 50, and they are also arranged in substantially opposite diametric positions with respect to each other on the first base end 15 of the tubular portion 12.

Each lever 30 also comprises a overhanging portion 34 connected to the lamellar base portion 31 and preferably positioned between the two side portions 32.

The overhanging portion 34 is preferably tilted with respect to the base portion 31 to allow the rotation of the respective lever 30 in one direction only.

The overhanging portion 34 is in contact with the corresponding knurled portion 52 with which it forms a unidirectional coupling (34, 52) which forms part of the supporting means 20.

Each overhanging portion 34 also has a cavity 35 situated between the overhanging portion and the knurled portion 52 which can be used for their decoupling.

Figure 6C:
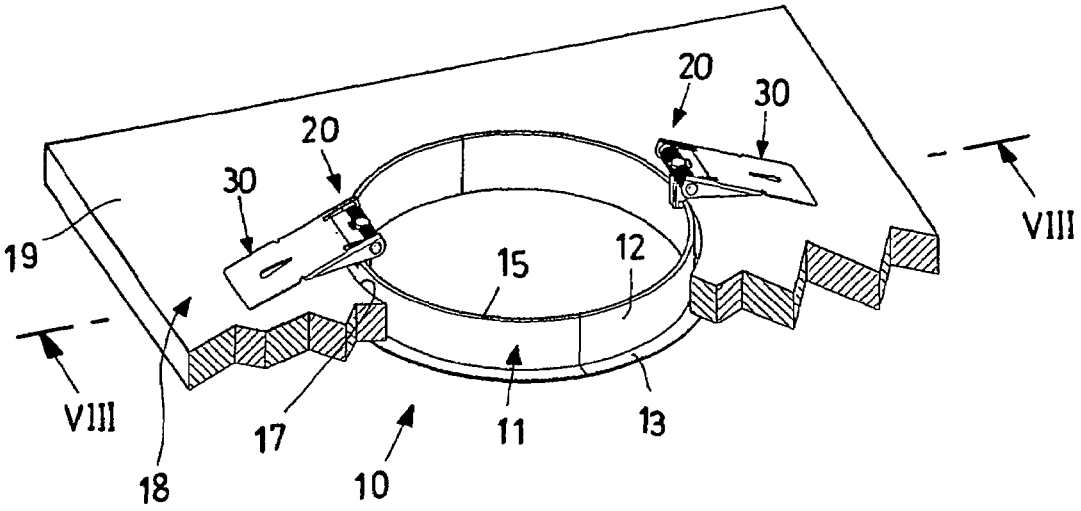

By means of the at least two unidirectional couplings (34, 52), the at least two levers 30 are capable of passing, by rotation, from a disengagement operating position in which they do not radially protrude from the tubular portion 12 of the frame 11 (FIG. 6A) to an engagement operating position in which they protrude radially from the tubular portion 12 of the frame 11 (FIG. 6C).

In this way, by going at least partially against a stop-end or in any case resting against an upper surface 19 of the wall 18, the at least two levers 30 support the device 10.

Figure 7C:
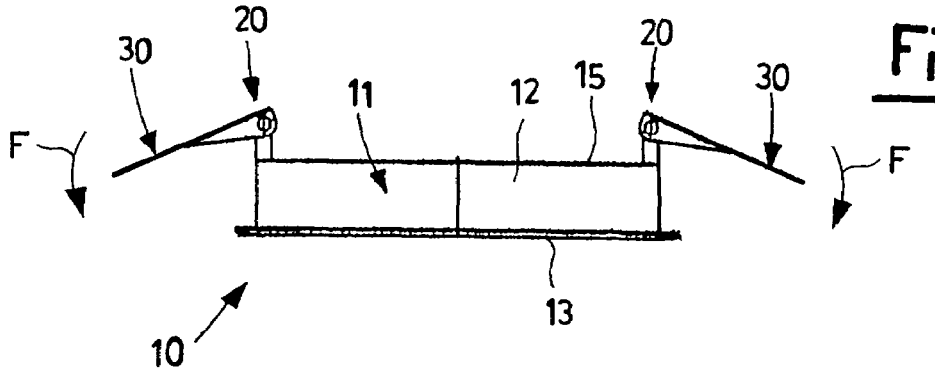

In the disengagement position (FIGS. 6A and 7A), each lever 30 enables the insertion of the tubular portion 12 in the opening 17 without interfering with it, thus allowing the easy positioning of the frame 11.

This is possible as each lever of said at least two levers 30 is rotationally associated with the tubular portion 12 of the frame 11, in particular with the first base end 15 of the tubular portion 12, by means of the unidirectional coupling (34, 52).

The supporting means 20 therefore comprise two unidirectional couplings (34, 52), each of which allows the corresponding lever 30 to pass only from the disengagement position to the engagement position by means of a rotational movement, but not vice versa.

This is possible as each overhanging portion 34 of each unidirectional coupling (34, 52) is capable of relatively rotating with respect to the corresponding knurled portion 52 only in the rotational direction of the arrow F (FIGS. 7A-7C), and is capable of wedging itself between a series of teeth of the knurled portion itself preventing rotation in the opposite direction.

In this way, only by pressure in the cavity 35, for example by means of a screwdriver, is it possible to decouple each of the unidirectional couplings (34, 52) to bring each lever 30 back into the disengagement position.

The flanged portion 13, by extending radially with respect to the tubular portion 12, advantageously allows the opening 17 to be completely covered, thus avoiding the necessity of subsequent finishing operations such as plastering or in any case filling the space between the edge of the opening 17 and the outer side surface of the tubular portion 12 of the frame 11, making the installation of the supporting device 10 more rapid and economical.

Figure 8:
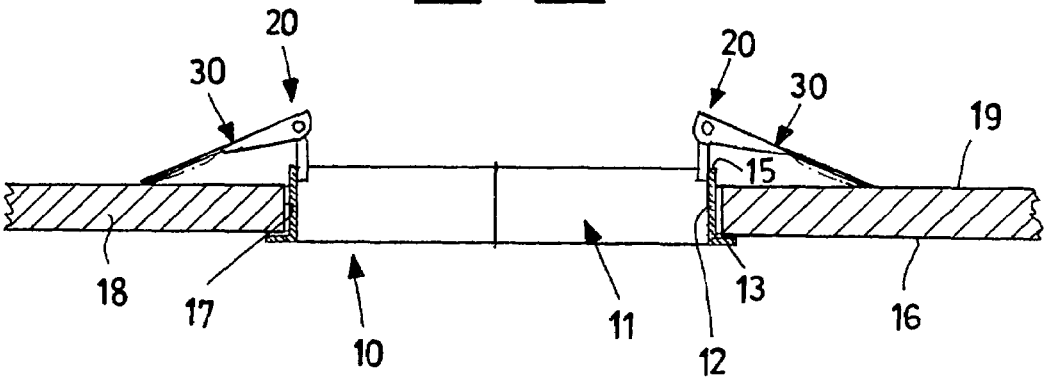
FIG. 8 is a sectional view according to the line VIII-VIII of FIG. 6C.

FIG. 8 illustrates a partially sectional view of FIG. 6C which shows the at least two levers 30, which, as they are partially elastically flexible, become deformed in the area Z, allowing perfect adaptation to the thickness of the wall 18, improving the fixing of the whole supporting device 10 in position.

The fixing is also improved as a result of the fact that the flanged portion 13 of the frame 11 goes against the stop-end of a lower surface 16 of the wall 18, whereas the upper surface 19 of the wall 18 is coupled with the at least two levers 30, blocking the frame 11 to the wall 18.

Figure 9:
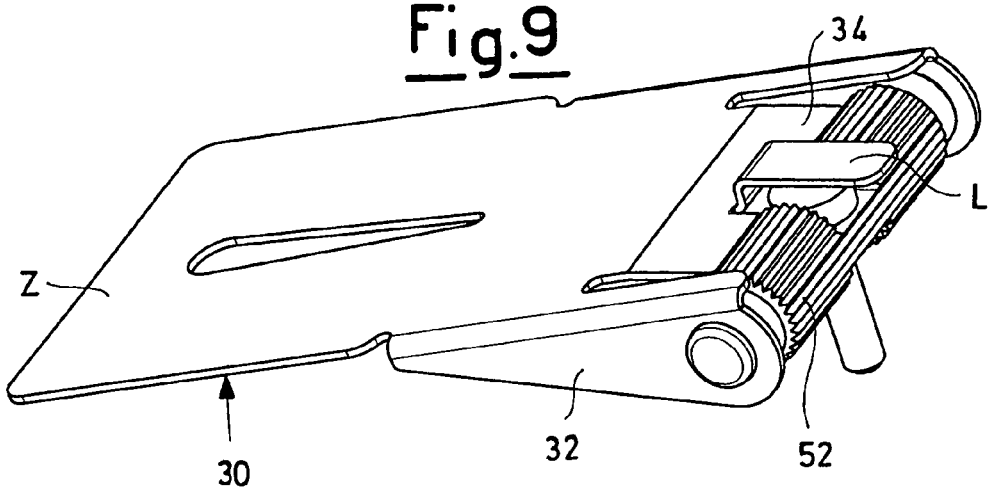
FIG. 9 is a perspective view illustrating a variant of the invention.
Figure 10:
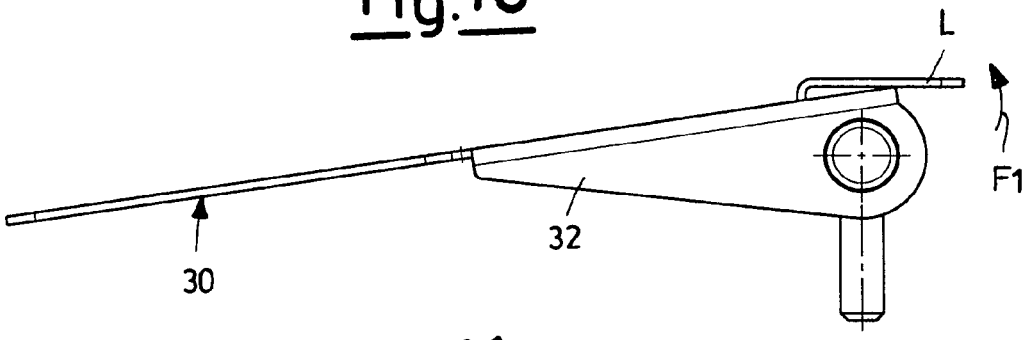
FIGS. 10, 11 are respectively a raised side view and a plan view of the variant of FIG. 9.
Figure 11:
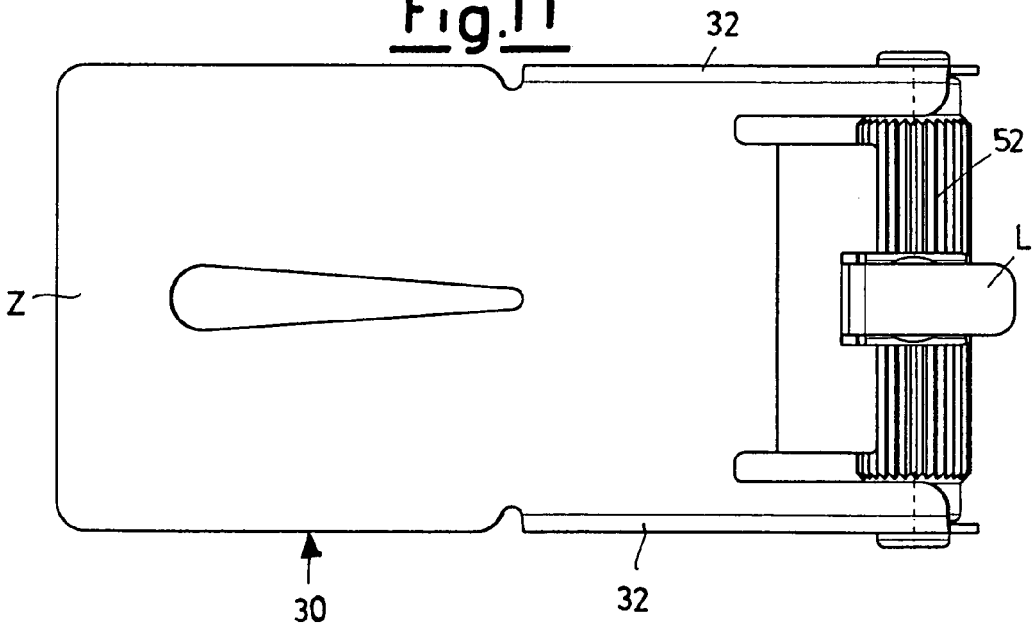

According to a variant of the invention, with reference to FIGS. 9-11, the disengagement of the lever 30 from the unidirectional coupling, can be effected, instead of by a screwdriver, by means of a maneuvering lever L which extends from the overhanging portion 34 allowing it to be also manually rotated in the direction of the arrow F1, disengaging the portion 34 itself from the knurled portion 52.

From the above description with reference to the figures, it is evident how a supporting device for a lighting appliance according to the invention is particularly useful and advantageous.

The objective specified in the preamble of the description has therefore been achieved.

The forms of the supporting device for a lighting appliance of the invention, as also the materials, can obviously differ from those shown for illustrative but non-limiting purposes in the drawings.

The protection scope of the invention is consequently delimited by the enclosed claims.

The invention claimed is:

1. A supporting device (10) for a lighting appliance comprising a frame (11) in turn comprising a tubular portion (12) which can be at least partially inserted in a housing or opening (17) of a false ceiling or wall (18), characterized in that it comprises supporting means (20) comprising at least two levers (30) associated with the frame (11) and capable of passing, by rotation, by means of two corresponding unidirectional couplings (34, 52) from a disengagement operating position, in which they do not protrude from said tubular portion (12), to an engagement operating position in which they protrude from said frame (11) becoming coupled with said wall (18) to support the device (10), the supporting device further characterized in that the at least two unidirectional couplings (34, 52) allow the corresponding lever (30) to only pass from the disengagement position to the engagement position through a rotational movement, but not vice versa, said at least two unidirectional couplings (34, 52) further comprised in that the unidirectional couplings comprise at least one knurled portion (52) and at least one overhanging portion (34) said lever (30) is further characterized in that it is at least partially constructed out of a flexible resilient material.

2. The supporting device (10) according to claim 1, characterized in that said supporting means (20) comprise at least two pins (50) fixed to a first base end (15) of said tubular portion (12).

3. The supporting device (10) according to claim 2, characterized in that each lever of said at least two levers (30) is associated with said tubular portion (12) of said frame (11) by means of a pin of said at least two pins (50) respectively.

4. The supporting device (10) according to claim 2, characterized in that each pin (50) comprises two ends (51) inserted in corresponding housings or holes (33) situated in the corresponding lever (30).

5. The supporting device (10) according to claim 2, characterized in that each pin (50) comprises a hole (53) for the insertion of a screw (54).

6. The supporting device (10) according to claim 2, characterized in that said at least one knurled portion (52) is situated on a side surface of each pin (50) and in that said at least one overhanging portion (34) is situated on a corresponding lever of said at least two levers (30).

7. The supporting device (10) according to claim 6, characterized in that each unidirectional coupling of said at least two unidirectional couplings (34, 52) comprises at least one cavity (35) for the disengagement of said at least two levers (30).

8. The supporting device (10) according to claim 6, characterized in that said at least one cavity (35) is situated on each overhanging portion (34) of each lever (30).

9. The supporting device (10) according to claim 8, characterized in that said at least one cavity (35) is a rear portion of each overhanging portion (34) to allow the disengagement of each lever (30).

10. The supporting device (10) according to claim 1, characterized in that each lever (30) comprises a base portion (31) and two side portions (32), opposite each other with respect to said base portion (31), said base portion (31) having at least one flexibly resilient area (Z).

11. The supporting device (10) according to claim 10, wherein said lever (30) has two holes (33), characterized in that said holes (33) are situated in each of said two side portions (32) respectively.

12. The supporting device (10) according to claim 10, characterized in that said overhanging portion (34) is tilted with respect to said base portion (31).

13. The supporting device (10) according to claim 1, characterized in that said at least two levers (30) axe fixed in diametrically opposite positions on a first base end (15) of said tubular portion (12) of the frame (11).

14. The supporting device (10) according to claim 1, characterized in that said frame (11) comprises at least two housings (14) situated on a first base end (15) of the tubular portion (12).

15. The supporting device (10) according to claim 1, characterized in that said frame (11) comprises a flanged portion (13) which extends radially from a second base end of the tubular portion (12) to cover said opening (17).

16. The supporting device (10) according to claim 1, characterized in that each lever (30) is at least partially constructed out of a flexible resilient material.

17. The supporting device (10) according to claim 1, characterized in that a maneuvering lever (L) extends from said overhanging portion (34).

* * * * *